US007337841B2

(12) United States Patent
Ravi

(10) Patent No.: US 7,337,841 B2
(45) Date of Patent: Mar. 4, 2008

(54) CASING COMPRISING STRESS-ABSORBING MATERIALS AND ASSOCIATED METHODS OF USE

(75) Inventor: Krishna M. Ravi, Kingwood, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 232 days.

(21) Appl. No.: 10/807,625

(22) Filed: Mar. 24, 2004

(65) Prior Publication Data

US 2005/0211445 A1 Sep. 29, 2005

(51) Int. Cl.
*E21B 43/02* (2006.01)

(52) U.S. Cl. ..... 166/285; 166/242.1

(58) Field of Classification Search ..... 166/285, 166/292, 242.1

See application file for complete search history.

(56) References Cited

U.S. PATENT DOCUMENTS

| | | | | |
|---|---|---|---|---|
| 2,230,626 | A | 2/1941 | Miller | 138/145 |
| 2,907,351 | A | 10/1959 | Rohrback et al. | 285/55 |
| 3,385,367 | A | 5/1968 | Kolisman | 166/191 |
| 3,406,756 | A | 10/1968 | Carter et al. | 166/285 |
| 3,719,230 | A | 3/1973 | Kemp et al. | 166/315 |
| 3,918,523 | A | 11/1975 | Stuber | 166/285 |
| 4,421,169 | A | 12/1983 | Dearth et al. | 166/285 |
| 4,716,965 | A | 1/1988 | Bol et al. | 166/292 |
| 4,936,386 | A | 6/1990 | Colangelo | 166/292 |
| 5,261,492 | A | 11/1993 | Duell et al. | 166/387 |
| 5,507,346 | A | 4/1996 | Gano et al. | 166/285 |
| 5,564,413 | A | 10/1996 | Hori et al. | 138/137 |
| 5,696,059 | A | 12/1997 | Onan et al. | 507/269 |
| 5,791,380 | A | 8/1998 | Onan et al. | 138/149 |
| 5,964,292 | A | 10/1999 | Hewitt | 166/292 |
| RE36,362 | E | 11/1999 | Jackson | 166/369 |
| 6,230,804 | B1 | 5/2001 | Meuller et al. | 166/293 |
| 6,237,688 | B1 | 5/2001 | Burleson et al. | 166/281 |
| 6,531,199 | B2 | 3/2003 | Usui | 428/35.9 |
| 6,564,870 | B1 | 5/2003 | Grigsby et al. | 166/313 |
| 6,848,505 | B2 | 2/2005 | Richard et al. | 166/285 |
| 2003/0173092 | A1 | 9/2003 | Wilson et al. | 166/387 |

FOREIGN PATENT DOCUMENTS

| | | |
|---|---|---|
| GB | 1 352 388 | 5/1974 |

OTHER PUBLICATIONS

Foreign communication from a related counterpart application dated Feb. 16, 2005.

*Primary Examiner*—William P Neuder
(74) *Attorney, Agent, or Firm*—Craig W. Roddy; Baker Botts, LLP

(57) ABSTRACT

The present invention relates to subterranean drilling and well completion operations, and more particularly, to improved casing that comprises stress-absorbing materials and associated methods of use. In some embodiments, the present invention discloses methods of casing a well bore that comprise the steps of providing a casing that comprises a stress-absorbing material; and placing the casing into the well bore. In other embodiments, the present invention provides improved casing that comprises stress-absorbing materials and methods of reducing the transmission of stress from a casing to a cement sheath.

55 Claims, 3 Drawing Sheets

CASING COMPRISING STRESS-ABSORBING MATERIALS AND ASSOCIATED METHODS OF USE

The present invention relates to subterranean drilling and well completion operations, and more particularly, to improved casing that comprises stress-absorbing materials and associated methods of use.

Subterranean well completion is the process where various apparatuses and materials may be inserted into a previously drilled well bore in a subterranean formation to facilitate the recovery of hydrocarbons therefrom. One aspect of well completion involves the insertion of a casing string into the well bore wherein the casing string may act, inter alia, to stabilize the well bore and control downhole pressures. Casing strings typically comprise a series of individual casings secured together, for example, by threaded couplings (e.g., casing collars). Casing strings also may be used in other subterranean operations, such as drilling operations.

Well completion also may involve primary cementing operations, where cement compositions are pumped into an annular space between the walls of a well bore and the exterior surface of a casing string disposed therein. In certain instances, the casing string may be placed into the well bore after the cement composition has been pumped into the well bore. The cement compositions are permitted to set in the annular space, thereby forming an annular sheath of hardened, substantially impermeable cement. Among other things, the cement sheath may act to substantially support the casing string within the well bore, to bond the exterior surface of the casing string to the wall of the well bore, and to obtain zonal isolation by preventing the flow of formation fluids into the well bore. Where zonal isolation is not achieved, problems may arise, including the undesirable flow of formation fluids into the annulus, for example. Cement compositions also may be used in remedial cementing operations such as plugging highly permeable zones or fractures in well bores, plugging cracks in pipe strings, and the like. The cement composition may include a wide variety of materials that set to form the desired cement sheath, including hydraulic cements, epoxy cements, polymeric-based systems, and other similar materials.

In certain subterranean operations, the cement sheath may be subjected to high stress that is transmitted, in part, by the casing string. As referred to herein, "stress" refers to the force applied over an area resulting from a strain caused by an incremental change of a body's length or volume. Such high stress may occur, for example, in operations associated with steam injection, heavy oil recovery, high pressure high temperature wells, deepwater wells, and geothermal wells. In other cases, the cement sheath may be subjected to mechanical stress induced by vibrations and impacts resulting from subterranean operations. In high stress operations such as those described above, the cement sheath may fail, inter alia, due to shear, tensional, and/or compressional stresses exerted thereon. Generally, such failures may be in the form of radial or circumferential cracking within the cement or shear failure as well as the break down of the bond between the cement and the casing or between the cement and the formation. These failures of the cement sheath are undesirable, inter alia, because they may lead to the loss of zonal isolation. In an attempt to counteract this problem, various additives, such as silica, foaming additives, and other mechanical property modifiers have been added to cement compositions. These additives are directed toward improving the properties of the set cement sheath. In an attempt to reduce the transfer of stress from the casing string to the cement sheath, the thickness of the casing may be increased. Due to the increased thickness, the weight of the casing string will increase. An increase in weight of the casing string may be problematic, inter alia, because there may be increased complexity and costs associated with use of a heavier casing string.

SUMMARY OF THE INVENTION

The present invention relates to subterranean drilling and well completion operations, and more particularly, to improved casing that comprises stress-absorbing materials and associated methods of use.

In some embodiments, the present invention provides an improved casing that comprises a stress-absorbing material.

In another embodiment, the present invention provides an improved casing that comprises a sleeve and a casing coating that comprises a stress-absorbing material disposed on the sleeve.

In another embodiment, the present invention provides a method of casing a well bore that comprises providing a casing that comprises a stress-absorbing material, and placing the casing into the well bore.

In another embodiment, the present invention provides a method of casing a well bore that comprises providing a casing that comprises a sleeve and a casing coating that comprises a stress-absorbing material disposed on the sleeve; and placing the casing into the well bore.

In yet another embodiment, the present invention provides a method of reducing the transmission of stress from a casing to a cement sheath that comprises providing a casing that comprises a stress-absorbing material; placing the casing into a well bore that penetrates a subterranean formation, thereby forming an annulus between the casing and the subterranean formation; placing a cement composition into the annulus; and allowing the cement composition to set within the annulus so as to bond the casing to a portion of the subterranean formation.

In another embodiment, the present invention provides a method of reducing the transmission of stress from a casing to a cement sheath that comprises providing a casing that comprises a sleeve and a casing coating that comprises a stress-absorbing material disposed on the sleeve; placing the casing into a well bore that penetrates a subterranean formation, thereby forming an annulus between the casing and the subterranean formation; placing a cement composition into the annulus; and allowing the cement composition to set within the annulus so as to bond the casing to a portion of the subterranean formation.

The features and advantages of the present invention will be readily apparent to those skilled in the art upon a reading of the description of the exemplary embodiments which follow.

BRIEF DESCRIPTION OF THE DRAWINGS

A more complete understanding of the present disclosure and advantages thereof may be acquired by referring to the following description taken in conjunction with the accompanying drawings, wherein.

Figure 1:
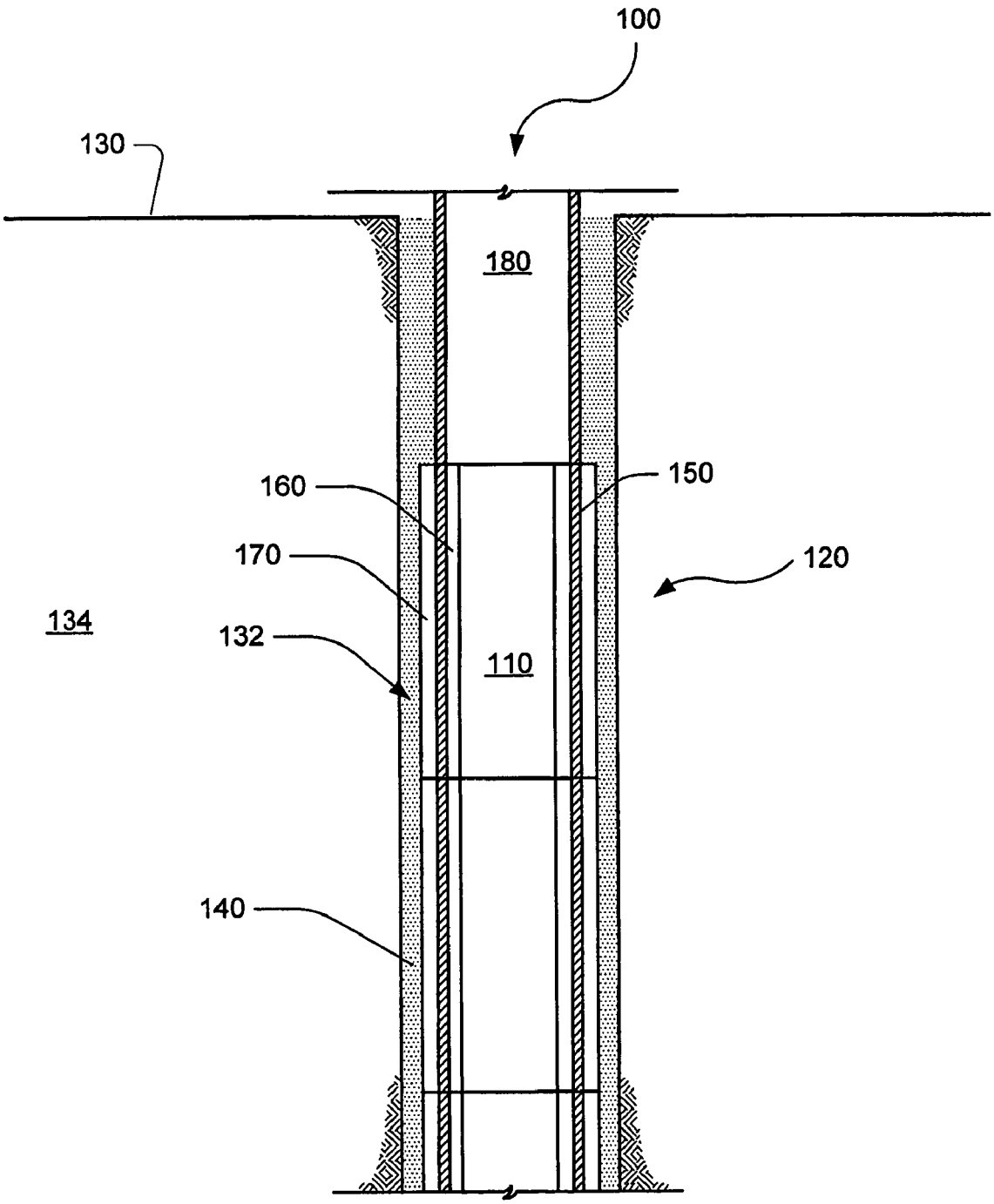
FIG. 1 is a side cross-sectional view of an embodiment of a casing string in a well bore that comprises casing of the present invention.

While the present invention is susceptible to various modifications and alternative forms, specific exemplary embodiments thereof have been shown by way of example in the drawings and are herein described in detail. It should be understood, however, that the description herein of specific embodiments is not intended to limit or define the invention to the particular forms disclosed, but on the contrary, the intention is to cover all modifications, equivalents, and alternatives falling within the spirit and scope of the invention as defined by the appended claims.

DETAILED DESCRIPTION OF EXEMPLARY EMBODIMENTS

The present invention relates to subterranean drilling and well completion operations, and more particularly, to improved casing that comprises stress-absorbing materials and associated methods of use.

The present invention provides improved casing that comprises a stress-absorbing material. In certain exemplary embodiments, the improved casing of the present invention comprises a sleeve and a casing coating that comprises a stress-absorbing material disposed on the sleeve. In another exemplary embodiment, the improved casing of the present invention comprises a sleeve and a stress-absorbing material that is embedded within the sleeve.

Referring to FIG. 1, an exemplary embodiment of casing string 100 in well bore 120 that comprises improved casing 110 of the present invention is illustrated. Casing string 100 is inserted into well bore 120 after well bore 120 has been drilled to a desired depth below surface 130 into subterranean formation 134. Annulus 132 is formed between casing string 100 and subterranean formation 134. Casing string 100 may be cemented to subterranean formation 134 by cement sheath 140, inter alia, to bond casing string 100 to a portion of subterranean formation 134. It should be understood by those skilled in the art that, in certain embodiments of the present invention, casing string 100 may not be cemented into well bore 120. Those of ordinary skill in the art will appreciate the circumstances when casing string 100 should or should not be cemented into well bore 120.

Casing string 100 comprises a series of interconnected sections of casing, including conventional casing 180 and improved casing 110. These sections of casing may be connected by any suitable method of connection, such as casing collars and flushjoint connections.

Figure 2:
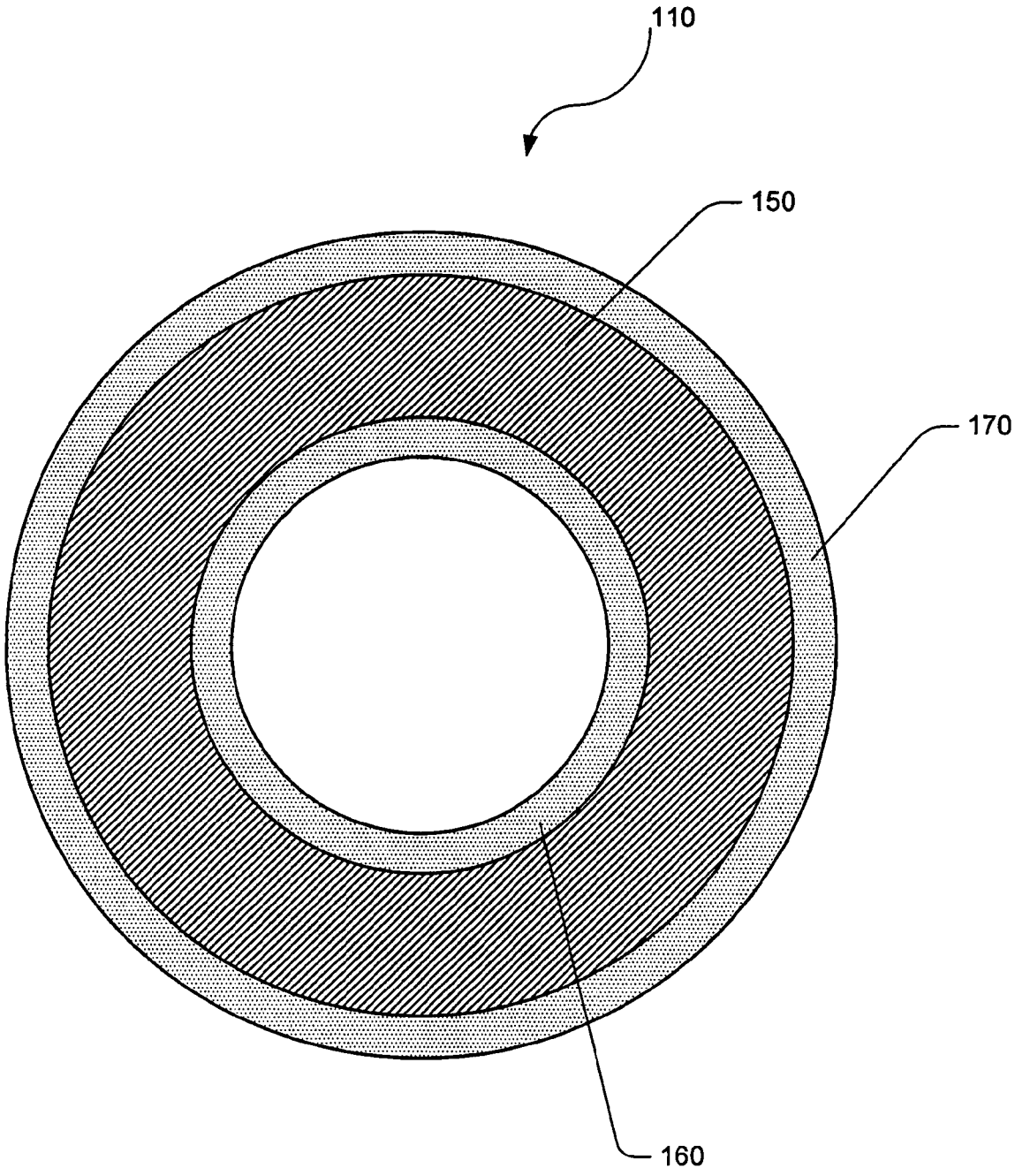
FIG. 2 is a top view of an embodiment of an improved casing of the present invention.

Improved casing 110 comprises sleeve 150; exterior casing coating 170 that comprises a stress-absorbing material disposed on an exterior surface of sleeve 150; and interior casing coating 160 that comprises a stress-absorbing material disposed on an interior surface of sleeve 150. A top view of one improved casing 110 is shown in FIG. 2. It should be understood by those skilled in the art with the benefit of this disclosure that one surface (e.g., the exterior surface or the interior surface) of sleeve 150 may be coated with a stress-absorbing material or more than one surface (e.g., the exterior surface and the interior surface) of sleeve 150 may be coated with a stress-absorbing material. Among other things, the presence of interior casing coating 160 and exterior casing coating 170 may act to remove filter cake from within well bore 120 when casing string 100 is placed into well bore 120. Casing string 100 may be placed into well bore 120 by any suitable method that does not detrimentally affect the performance of interior casing coating 160 and/or exterior casing coating 170. One of ordinary skill in the art, with the benefit of this disclosure, will be able to determine an appropriate method of installing casing string 100 for a chosen application. Furthermore, after casing string 100 has been placed into well bore 120, a cement composition may be placed into annulus 132 formed between casing string 100 and subterranean formation 134. The cement composition may be allowed to set in annulus 132 so as to bond casing string 100 to a portion of subterranean formation 134.

Figure 3:
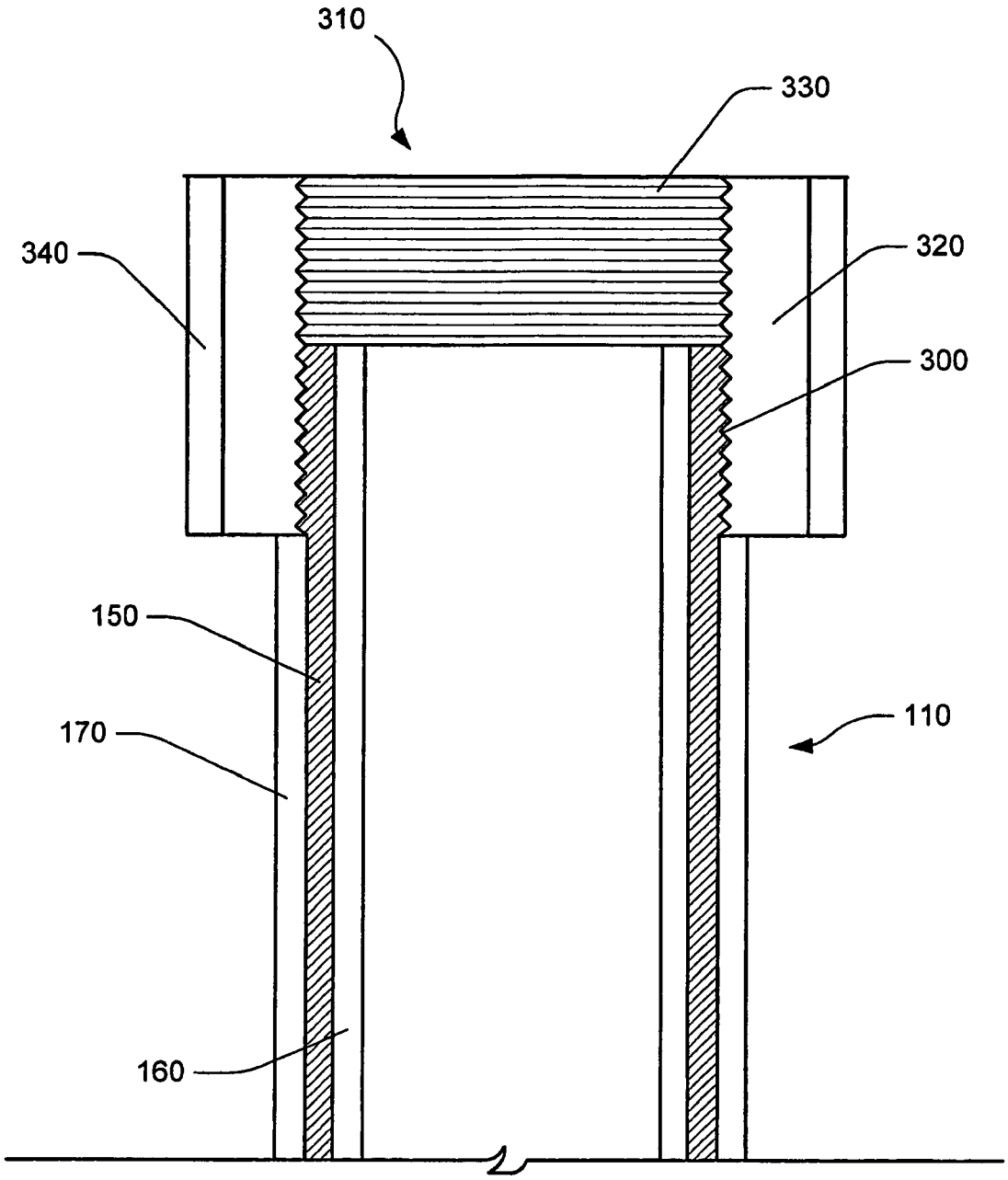
FIG. 3 is a side cross-sectional view of an embodiment of an improved casing of the present invention wherein a casing collar is connected to the improved casing.

Referring now to FIG. 3, a cross-sectional view of an exemplary embodiment of improved casing 110 of the present invention is illustrated. Improved casing 110 comprises sleeve 150 that comprises casing threading 300 on an exterior surface of one end of sleeve 150. Improved casing 110 further comprises exterior casing coating 170 that comprises a stress-absorbing material disposed on an exterior surface of sleeve 150. Improved casing 110 further comprises interior casing coating 160 that comprises a stress-absorbing material disposed on an interior surface of sleeve 150. In certain embodiments of the present invention, casing threading 300 of sleeve 150 may not be coated with a stress-absorbing material. Casing collar 310 is connected to one end of improved casing 110. Casing collar 310 comprises a hollow cylindrically shaped housing 320 that comprises collar threading 330 on an interior surface of housing 320. Casing collar 310 further comprises collar coating 340 that comprises a stress-absorbing material disposed on an exterior surface of housing 320.

In accordance with the present invention, sleeve 150 of improved casing 110 generally may be a hollow cylindrically shaped pipe. In certain embodiments, sleeve 150 may comprise casing threading (e.g., casing threading 300) on an exterior surface at each end of sleeve 150. For example, sleeve 150 may be a conventional casing that is typically used in subterranean operations. Generally, conventional casing, depending upon the use, may be manufactured from a variety of materials, including ferrous materials, aluminum, titanium, or fiberglass.

Housing 320 of casing collar 310 generally may be a hollow cylindrically shaped housing. In certain embodiments, housing 320 may comprise collar threading 330 on interior surface of housing 320. For example, housing 320 may be a conventional casing collar that is typically used in subterranean operations. Generally, conventional casing collars, depending upon the use, may be manufactured from a variety of materials, including ferrous materials, aluminum, titanium, or fiberglass.

In certain embodiments of the present invention, a stress-absorbing material forms a casing coating (e.g., interior casing coating 160, exterior casing coating 170, or both) on a surface of sleeve 150. As illustrated in FIGS. 1 and 2, exterior casing coating 170 surrounds at least a portion of sleeve 150. Further, in certain embodiments of the present invention, a stress-absorbing material forms a collar coating (e.g., collar coating 340) on a surface (e.g., an exterior surface) of housing 320. The casing coating and collar coating generally may be applied to sleeve 150 and/or housing 320 by any suitable method. Examples of suitable methods for applying the collar coating and the casing coating include, but are not limited to, extrusion, spraying, showering, dipping, brush coating, powder coating, hot melting, or the like.

The casing coating that comprises the stress absorbing material should be of sufficient thickness to provide a desired level of stress absorbency. In some embodiments, the casing coating may have a thickness of less than about 3 inches. In another exemplary embodiment, the casing coating has a thickness in the range of from about 0.0625 inches to about 0.25 inches. Generally, the collar coating may be of similar thickness to the casing coating. While the stress-absorbing material may be applied to a surface of sleeve 150 or housing 320 in a desired thickness, it is not necessary for all surfaces of sleeve 150 and/or housing 320 to be coated with a uniform thickness of the stress-absorbing material.

In another embodiment of the present invention, the improved casing of the present invention may be formed from a suitable stress-absorbing material. In another embodiment of the present invention, the casing collars of the present invention may be formed from a suitable stress-absorbing material. As one of ordinary skill in the art will appreciate, any number of means may be used to form the improved casing and/or casing collars using a suitable stress-absorbing material.

In another embodiment of the present invention, the improved casing of the present invention may comprise a sleeve and a stress-absorbing material that is embedded within the sleeve. The sleeve may be the same as those described above. In order to embed the stress-absorbing material within the sleeve, the stress-absorbing material, for example, may be included as part of the melt when the sleeve is cast. In an exemplary embodiment, the sleeve is cast with a stress-absorbing material and a ferrous metal so that the improved casing comprises a stress-absorbing material embedded within the sleeve. In an exemplary embodiment of the present invention, the casing collars of the present invention comprise a hollow cylindrically shaped housing and a stress-absorbing material embedded within the housing. One of ordinary skill in the art with the benefit of this disclosure will be able to determine the appropriate method to embed the stress-absorbing material within the sleeve and/or housing for a particular application.

Suitable stress-absorbing materials generally may be materials suitable for use in subterranean operations, inter alia, that are capable of reducing the transmission of stress to a cement sheath from a casing string when used in accordance with the methods and apparatus of the present invention. Such materials would include materials that are capable of at least partially enhancing the stress-strain relationship of an embodiment of the improved casing of the present invention as compared to a conventional casing. Among other things, the stress-absorbing material chosen should not adversely affect well bore fluids, such as drilling fluids, completion fluids, and formation fluids. Suitable stress-absorbing materials include, but are not limited to, fibers, resins, elastomers, or combinations thereof. Examples of suitable fibers include, but are not limited to, polypropylene fibers, nylon fibers, and carbon fibers. Examples of suitable elastomers include, but are not limited to, styrene, butadiene, and polyvinyl alcohol. Examples of suitable resins include, but are not limited to, polyurethane and formaldehyde.

In certain embodiments, one might choose to use the improved casing and casing collars of the present invention only in high stress zones of a subterranean formation, inter alia, due to practical limitations, such as economics. For example, a cement design simulator, such as "WellLife®" simulation, may be used to determine the high stress zones of the subterranean formation. WellLife® simulation is a cement design simulation that is commercially available from Halliburton Energy Services, Duncan, Okla. The improved casing and casing collars of the present invention may be utilized in the high stress zones of the subterranean formation as indicated by the cement design simulator to at least partially reduce the transmission of stress to the cement sheath from the casing string. One of ordinary skill in the art, with the benefit of this disclosure, will be able to determine the appropriate high stress zones where use of the improved casing and casing collars of the present invention may be particularly beneficial and cost effective.

Generally, the casing strings of the present invention that comprises the improved casing of the present invention may comprise any type of casing that is suitable for use in subterranean operations. For example, at least a portion of the casing string may comprise conductor casing, surface casing, intermediate casing, production casing, liners, or tieback strings.

In some embodiments, the present invention provides an improved casing that comprises a stress-absorbing material.

In another embodiment, the present invention provides an improved casing that comprises a sleeve and a casing coating that comprises a stress-absorbing material disposed on the sleeve.

In another embodiment, the present invention provides a method of casing a well bore that comprises providing a casing that comprises a stress-absorbing material, and placing the casing into the well bore.

In another embodiment, the present invention provides a method of casing a well bore that comprises providing a casing that comprises a sleeve and a casing coating that comprises a stress-absorbing material disposed on the sleeve; and placing the casing into the well bore.

In yet another embodiment, the present invention provides a method of reducing the transmission of stress from a casing to a cement sheath that comprises providing a casing that comprises a stress-absorbing material; placing the casing into a well bore that penetrates a subterranean formation, thereby forming an annulus between the casing and the subterranean formation; placing a cement composition into the annulus; and allowing the cement composition to set within the annulus so as to bond the casing to a portion of the subterranean formation.

In another embodiment, the present invention provides a method of reducing the transmission of stress from a casing to a cement sheath that comprises providing a casing that comprises a sleeve and a casing coating that comprises a stress-absorbing material disposed on the sleeve; placing the casing into a well bore that penetrates a subterranean formation, thereby forming an annulus between the casing and the subterranean formation; placing a cement composition into the annulus; and allowing the cement composition to set within the annulus so as to bond the casing to a portion of the subterranean formation.

Therefore, the present invention is well adapted to carry out the objects and attain the ends and advantages mentioned as well as those which are inherent therein. While numerous changes may be made by those skilled in the art, such changes are encompassed within the spirit of this invention as defined by the appended claims.

What is claimed is:

1. A method of casing a well bore comprising:

placing a casing into the well bore, the casing comprising a sleeve comprising a ferrous material, aluminum, or titanium, a stress-absorbing material that is disposed on the sleeve to form a casing covering, wherein the casing covering substantially covers a circumferential area of the sleeve along a length of the sleeve, and a collar connected to an end of the sleeve, the collar comprising the stress-absorbing material.

2. The method of claim 1 wherein the stress-absorbing material is directly coated on an interior surface of the sleeve.

3. The method of claim 1 wherein the stress-absorbing material is directly coated on an exterior surface of the sleeve.

4. The method of claim 1 wherein the casing covering has a thickness of less than about three inches.

5. The method of claim 1 wherein the stress-absorbing material is applied to the sleeve by extrusion, showering, dipping, brush coating, powder coating, or hot melting.

6. The method of claim 1 wherein the stress-absorbing material comprises a fiber, a resin, or an elastomer.

7. The method of claim 1 wherein the collar further comprises a hollow cylindrically shaped housing.

8. The method of claim 7 wherein the stress-absorbing material is embedded within the cylindrically shaped housing.

9. The method of claim 7 wherein the stress-absorbing material forms a collar coating coated on a surface of the hollow cylindrically shaped housing.

10. The method of claim 1 further comprising determining a high stress zone of a subterranean formation penetrated by the well bore, and wherein placing the casing into the well bore comprises placing the casing into the high stress zone.

11. A method of casing a well bore comprising:

placing a casing into the well bore, the casing comprising a sleeve, and a casing covering comprising a stress-absorbing material, wherein the stress-absorbing material comprises fibers and completely covers an exterior area of the sleeve, wherein the exterior area extends completely around a circumference of the sleeve and along a length of the sleeve, the circumference having a diameter perpendicular to a longitudinal axis of the sleeve and the length being parallel to the longitudinal axis of the sleeve.

12. The method of claim 11 wherein the casing covering is directly coated on the exterior area of the sleeve.

13. The method of claim 11 wherein the stress-absorbing material is directly coated on an interior surface of the sleeve.

14. The method of claim 11 wherein the casing covering has a substantially consistent thickness of less than about three inches.

15. The method of claim 11 wherein the casing covering is applied to the sleeve by extrusion, showering, dipping, brush coating, powder coating, or hot melting.

16. The method of claim 11 wherein the fibers comprise polypropylene fibers, nylon fibers, or carbons fibers.

17. The method of claim 11 wherein a casing collar is connected to an end of the casing.

18. The method of claim 17 wherein the casing collar comprises a hollow cylindrically shaped housing, and a collar coating comprising a stress-absorbing material coated on the hollow cylindrically shaped housing.

19. The method of claim 11 further comprising determining a high stress zone of a subterranean formation penetrated by the well bore, and wherein placing the casing into the well bore comprises placing the casing into the high stress zone.

20. The method of claim 11 wherein the sleeve comprises ferrous material, aluminum, or titanium.

21. A method of reducing the transmission of stress from a casing to a cement sheath comprising:

placing the casing into a well bore that penetrates a subterranean formation, the casing comprising a sleeve, a stress-absorbing material that is disposed on the sleeve to form a casing covering, and a collar connected to an end of the sleeve, the collar comprising the stress-absorbing material, wherein the casing covering completely covers an exterior area of the sleeve, wherein the exterior area extends completely around a circumference of the sleeve and along a length of the sleeve, the circumference having a diameter perpendicular to a longitudinal axis of the sleeve and the length being parallel to the longitudinal axis of the sleeve;

placing a cement composition into an annulus between the casing and the subterranean formation; and allowing the cement composition to set within the annulus so as to bond the casing to a portion of the subterranean formation.

22. The method of claim 21 wherein the stress-absorbing material is directly coated on an interior surface of the sleeve.

23. The method of claim 21 wherein the casing covering is directly coated on the exterior area of the sleeve.

24. The method of claim 21 wherein the casing covering has a substantially consistent thickness of less than about three inches.

25. The method of claim 21 wherein the casing covering is applied to the sleeve by extrusion, showering, dipping, brush coating, powder coating, or hot melting.

26. The method of claim 21 wherein the stress-absorbing material comprises a fiber, a resin, or an elastomer.

27. The method of claim 21 wherein the collar further comprises a hollow cylindrically shaped housing.

28. The method of claim 27 wherein the stress-absorbing material is embedded within the cylindrically shaped housing.

29. The method of claim 27 wherein the stress-absorbing material forms a collar coating coated on a surface of the hollow cylindrically shaped housing.

30. The method of claim 21 further comprising determining a high stress zone in the subterranean formation, and wherein placing the casing into the well bore comprises placing the casing into the high stress zone.

31. A method of reducing the transmission of stress from a casing to a cement sheath comprising:

placing the casing into a well bore that penetrates a subterranean formation, the casing comprising a sleeve, and a casing covering comprising a stress-absorbing material disposed on the sleeve, wherein the stress-absorbing material comprises fibers and completely covers an exterior area of the sleeve, wherein the exterior area extends completely around a circumference of the sleeve and along a length of the sleeve, the circumference having a diameter perpendicular to a longitudinal axis of the sleeve and the length being parallel to the longitudinal axis of the sleeve; and placing a cement composition into an annulus between the casing and the subterranean formation; and allowing the cement composition to set within the annulus so as to bond the casing to a portion of the subterranean formation.

32. The method of claim 31 wherein the casing covering is directly coated on the exterior area.

33. The method of claim 31 wherein the stress-absorbing material is directly coated on an interior surface of the sleeve.

34. The method of claim 31 wherein the casing covering has a substantially consistent thickness of less than about three inches.

35. The method of claim 31 wherein the casing covering is applied to the casing by extrusion, showering, dipping, brush coating, powder coating, or hot melting.

36. The method of claim 31 wherein the fibers comprise polypropylene fibers, nylon fibers, or carbons fibers.

37. The method of claim 31 wherein a casing collar is connected to an end of the casing.

38. The method of claim 37 wherein the casing collar comprises a hollow cylindrically shaped housing, and a collar coating comprising the stress-absorbing material disposed on the housing.

39. The method of claim 31 further comprising determining a high stress zone in the subterranean formation, and wherein placing the casing into the well bore comprises placing the casing into the high stress zone.

40. An improved casing comprising a sleeve, a stress-absorbing material that is disposed on the sleeve to form a casing covering, and a collar connected to an end of the sleeve, the collar comprising the stress-absorbing material, wherein the casing covering completely covers an exterior area of the sleeve, wherein the exterior area extends completely around a circumference of the sleeve and along a length of the sleeve, the circumference having a diameter perpendicular to a longitudinal axis of the sleeve and the length being parallel to the longitudinal axis of the sleeve.

41. The improved casing of claim 40 wherein the stress-absorbing material is directly coated on an interior surface of the sleeve.

42. The improved casing of claim 40 wherein the casing covering is directly coated on the exterior area of the sleeve.

43. The improved casing of claim 40 wherein the casing covering has a substantially consistent thickness of less than about three inches.

44. The improved casing of claim 40 wherein the casing covering is applied to the sleeve by extrusion, showering, dipping, brush coating, powder coating, or hot melting.

45. The improved casing of claim 40 wherein the stress-absorbing material comprises a fiber, a resin, or an elastomer.

46. An improved casing comprising:

a sleeve; and a casing covering comprising a stress-absorbing material that completely covers an exterior area of the sleeve, wherein the exterior area extends completely around a circumference of the sleeve and along a length of the sleeve, the circumference having a diameter perpendicular to a longitudinal axis of the sleeve and the length being parallel to the longitudinal axis of the sleeve, wherein the stress-absorbing material comprises fibers.

47. The improved casing of claim 46 wherein the stress-absorbing material is directly coated on an interior surface of the sleeve.

48. The improved casing of claim 46 wherein the casing covering is directly coated on the exterior area of the sleeve.

49. The improved casing of claim 46 wherein the casing covering has a substantially consistent thickness of less than about three inches.

50. The improved casing of claim 46 wherein the casing coating is applied to the sleeve by extrusion, showering, dipping, brush coating, powder coating, or hot melting.

51. The improved casing of claim 46 wherein the fibers comprise polypropylene fibers, nylon fibers, or carbons fibers.

52. A method of casing a well bore comprising:

placing a casing into the well bore, the casing comprising:

a sleeve comprising a ferrous material, aluminum or titanium, and a stress absorbing material comprising fibers, wherein the stress absorbing material substantially covers a circumferential area of the sleeve along a length of the sleeve.

53. The method of claim 52 comprising placing a cement composition into an annulus between the casing and a wall of the well bore.

54. The method of claim 52, wherein the stress absorbing material has a substantially consistent thickness of less than about three inches completely covering the circumferential area of the sleeve along the length of the sleeve.

55. The method of claim 52, wherein the fibers comprise polypropolene fibers, nylon fibers, or carbon fibers.

* * * * *